US005180015A

United States Patent [19]

Ringgenberg et al.

[11] Patent Number: 5,180,015

[45] Date of Patent: Jan. 19, 1993

[54] HYDRAULIC LOCKOUT DEVICE FOR PRESSURE CONTROLLED WELL TOOLS

[75] Inventors: Paul D. Ringgenberg, Carrollton; Kevin R. Manke, Flower Mound, both of Tex.

[73] Assignee: Halliburton Company, Duncan, Okla.

[21] Appl. No.: 592,686

[22] Filed: Oct. 4, 1990

[51] Int. Cl.[5] ..... E21B 33/12

[52] U.S. Cl. ..... 166/386; 166/324; 166/375

[58] Field of Search ..... 166/386, 373, 374, 375, 166/324, 331

[56] References Cited

U.S. PATENT DOCUMENTS

| | | | |
|---|---|---|---|
| 4,589,485 | 5/1986 | Wray | 166/250 |
| 4,595,060 | 6/1986 | Beck | 166/324 X |
| 4,617,999 | 10/1986 | Beck | 166/321 X |
| 4,633,952 | 1/1987 | Ringgenberg | 166/336 |
| 4,664,196 | 5/1987 | Manke | 166/321 X |
| 4,665,991 | 5/1987 | Manke | 166/321 X |
| 4,711,305 | 12/1987 | Ringgenberg | 166/336 |

*Primary Examiner*—Ramon S. Britts
*Assistant Examiner*—Roger J. Schoeppel
*Attorney, Agent, or Firm*—Arnold, White & Durkee

[57] ABSTRACT

Well tools are provided which although pressure responsive, may be maintained by a hydraulic lockout in a nonresponsive condition until a threshold actuation step is performed. This lockout may be achieved by a hydraulic mechanism which allows pressure to be stored in a fluid spring during periods of increased pressure at the pressure source, and which traps these pressures even when pressure at the pressure source is reduced. When the tool is desired to be responsive to pressure cycles, a valve may be opened communicating the pressure in the fluid spring to a movable member in the well tool. This differential may be established by a differential between the pressure in the fluid spring and the pressure source. Communication of pressure in the fluid spring to a movable mandrel will then allow operation of the well tool in response to pressure cycles at the pressure source in accordance with the established design of the well tool.

18 Claims, 9 Drawing Sheets

FIG.2E
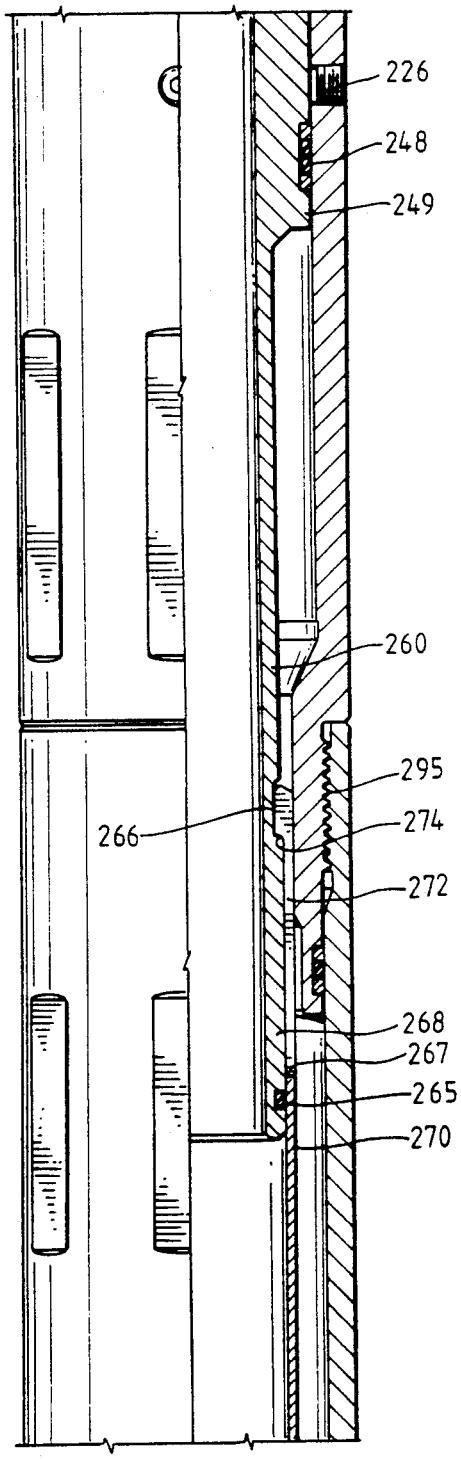
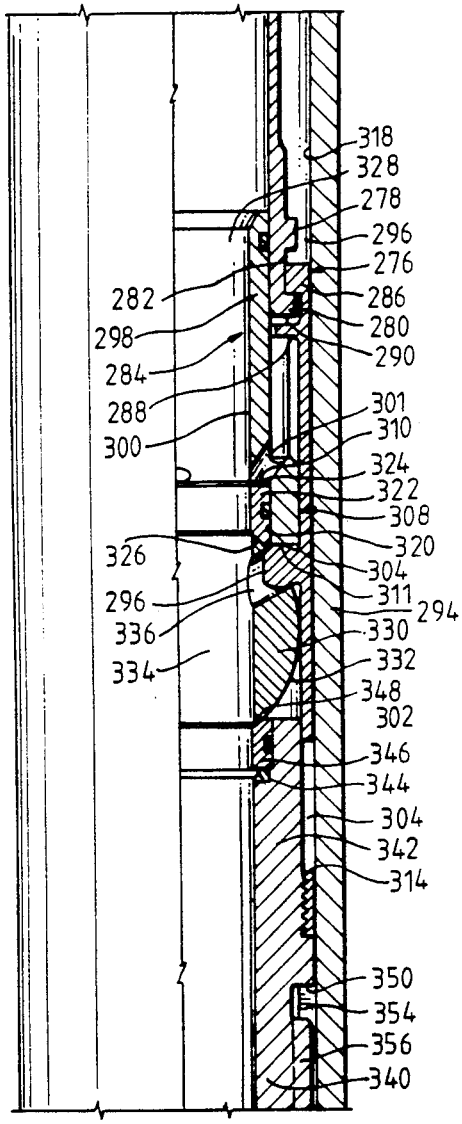
FIG.2F

HYDRAULIC LOCKOUT DEVICE FOR PRESSURE CONTROLLED WELL TOOLS

BACKGROUND OF THE INVENTION

The present invention relates generally to pressure controlled well tools, and more specifically relates to methods and apparatus for selectively "locking out" or preventing operation of selected pressure controlled well tools until such time as operation is desired.

Many types of well tools are known which are responsive to pressure, either in the annulus or in the tool string, in order to operate. For example, different types of tools for performing drill stem testing operations are responsive to either tubing or annulus pressure, or to a differential therebetween. Additionally, other tools such as safety valves or drill string drain valves may be responsive to such a pressure differential.

Such well tools typically have some member, such as a piston, which moves in response to the selected pressure stimuli. Additionally, these well tools also typically have some mechanism to prevent movement of this member until a certain pressure threshold has been reached. For example, a piston may be either mechanically restrained by a mechanism such as shear pins or similar devices; whereby the pressure must exceed the shear value of the restraining shear pins for the member to move. Alternatively, a rupture disk designed to preclude fluid flow until a certain threshold pressure differential is reached may be placed in a passage between the movable member and the selected pressure source. Each of these techniques is well known to the art.

Disadvantages may be found where multiple pressure operated tools are utilized in a single tool string. Conventional methods and apparatus for operating two tools in a tool string from the same pressure source (i.e., for example, the well annulus) are to establish the tool string such that the operating pressures for the tool to be operated second are at a pressures value greater than that required to operate the first tool. In some circumstances, this can present a disadvantage in that the releasing and operating pressure for the second-operated tool may be required to be higher than would be desirable. For example, in the above-stated example, it could be undesirable to apply the degree of pressure to the well annulus which might be necessary to operate the second-operated tool.

Additionally, in some types of tools it would be desirable to have a well tool operate in response to a specific and predetermined pressure differential for use when conditions in the well have changed. For example, where a tool is to be operated in response to pressure.

Accordingly, the present invention provides a new method and apparatus whereby a pressure operated well tool may be restricted from operation, and may be selectively enabled for operation while minimizing or eliminating pressure applications required to achieve such enabling; and whereby pressure previously applied to a pressure source may be stored in a well tool and used to facilitate operation of the well tool at a desired pressure differential.

SUMMARY OF THE INVENTION

The present invention provides methods and apparatus useful with pressure responsive well tools or well apparatus which will maintain the well tool in a nonresponsive condition to pressure changes or cycles at the pressure source until such time as the tool is desired to be rendered responsive to such pressure cycles.

For example, in one preferred embodiment, an apparatus in accordance with the present invention will include a movable member which will, when the tool is operable, be responsive to pressure stored in a variable fluid spring. The methods and apparatus of the present invention allow pressure increases at the pressure source to be stored in such fluid spring, thereby increasing the force of the spring, but will preclude the release of such fluid spring relative to the movable member. In such preferred embodiment, the well tool will include a releasable means, which may be, for example, a pressure differential responsive valve, such as a rupture disk. When the specified pressure is applied across this pressure differential responsive valve, such as by increasing the pressure at the pressure source and then decreasing the pressure at the pressure source, the valve will open, thereby communicating pressure of the fluid spring to the movable mandrel.

In one particularly preferred embodiment and method of implementation of the present invention, the well tool includes one or more valve members which are responsive to movement of a mandrel. In an application where the well tool is responsive to annulus pressure, the annulus pressure will be supplied through a fluid medium, such as a generally noncompressible oil, through a hydraulic lockout sub, to one side of a movable piston. Movement of the piston serves to compress a compressible gas which forms the variable fluid spring. Any increase in pressure in the well annulus will be communicated through the fluid body and hydraulic lockout sub to the fluid spring until the pressures are substantially equalized (discounting, for example, frictional losses within the tool). The hydraulic lockout sub, however, precludes the release of fluid, and therefore the release of pressure from said fluid spring, upon a decrease in fluid pressure in the well annulus. In one particularly preferred embodiment, this is accomplished through use of a one way check valve which precludes the return of fluid when there is a pressure differential in favor of the fluid spring. Pressure from the fluid spring is also precluded from being released to the movable mandrel by means of a rupture disk. This arrangement allows an essentially infinite number of cycles of pressure in the well annulus, so long as those cycles do not exceed a predetermined value. This predetermined value is the yield pressure of the rupture disk.

Once it is desired to make the well tool responsive to a pressure cycle, the pressure will be cycled to this predetermined yield pressure. This pressure will then be communicted through the body of fluid in the tool and into the fluid spring, as with previous cycles. However, once the pressure is reduced, and the yield pressure differential across the valve member (in this preferred case, a rupture disk) is achieved, the rupture disk will break, allowing application of the force stored in the fluid spring to the movable mandrel. The movable mandrel of the tool may then be manipulated according to its design criteria in response to cycles of pressure in the well annulus.

In one preferred implementation of the invention, the rupture disk yield pressure will be set at a pressure which is higher, by some safety margin, than the expected or foreseeable degree of pressurization to be achieved during pressure cycles during which the well tool is desired to remain nonresponsive. For example, in an environment where the "baseline" pressure is to be hydrostatic pressure, and where the pressure cycles which are foreseeable before the well tool of the present invention is expected to operate are expected to be approximately 500 psi. or less, the rupture disk would preferably be established at some substantial safety margin, such as, for example, 1,000 psi.

BRIEF DESCRIPTION OF THE DRAWINGS

FIGS. 2A-G depict an exemplary well tool, in this case a multi-mode testing tool including both a circulating valve and a well closure valve, in accordance with the present invention, illustrated partially in half vertical section.

DETAILED DESCRIPTION OF THE PREFERRED EMBODIMENTS

Figure 1:
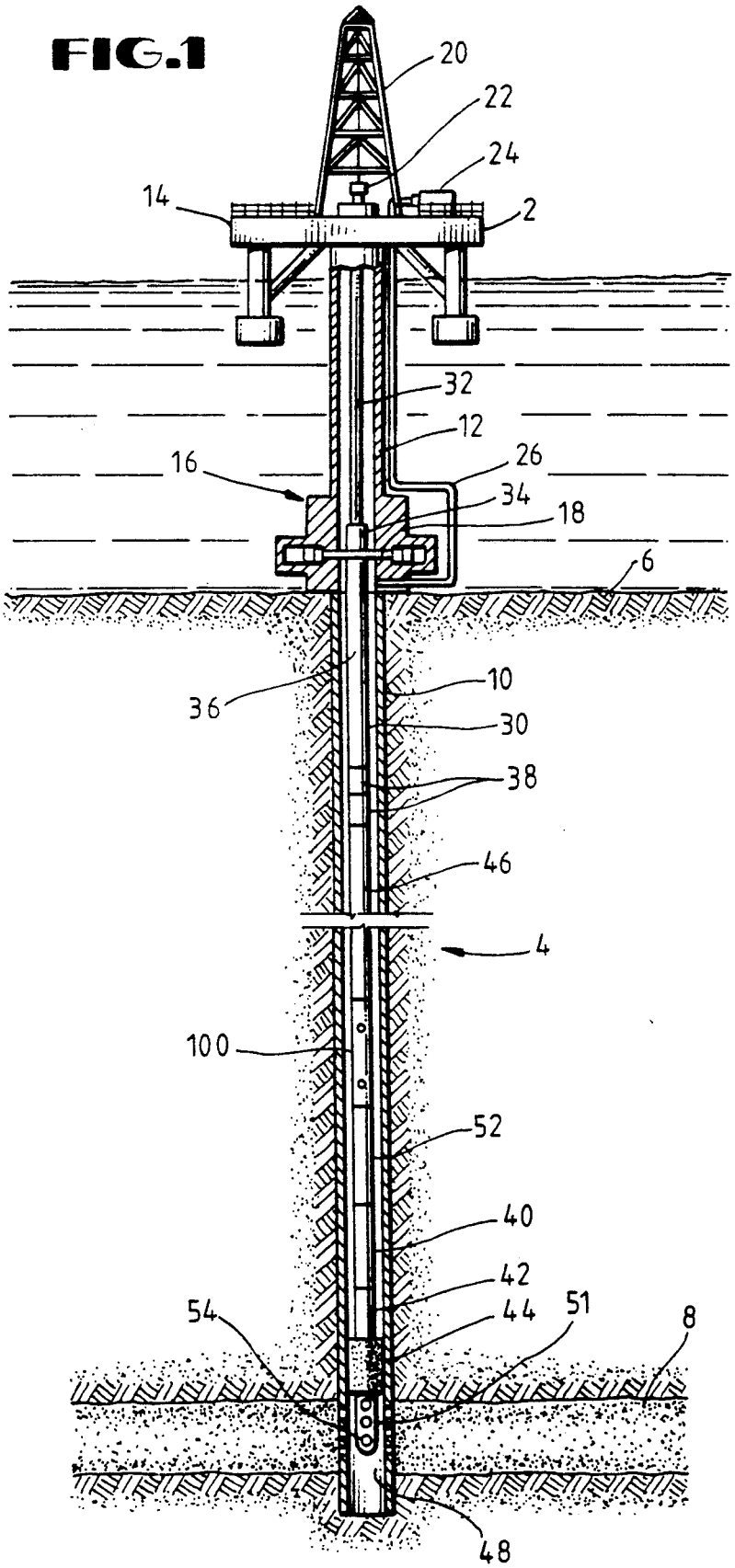
FIG. 1 depicts an exemplary testing string deployed relative to an offshore oil or gas well, which string includes an apparatus in accordance with the present invention in one exemplary operating environment.

Referring now to the drawings in more detail, and particularly to FIG. 1, therein is depicted an exemplary multi-mode testing tool 100 operable in accordance with the methods and apparatus of the present invention, in an exemplary operating environment, disposed adjacent a potential producing formation in an offshore location.

In the depicted exemplary operating environment, an offshore platform 2 is shown positioned over submerged oil or gas wellbore 4 located in the sea floor 6, with wellbore 4 penetrating a potential producing formation 8. Wellbore 4 is shown to be lined with steel casing 10, which is cemented into place. A sub sea conduit 12 extends from the deck 14 of platform 2 into a sub sea wellhead 16, which includes blowout preventer 18 therein. Platform 2 carries a derrick 20 thereon, as well a hoisting apparatus 22, and a pump 24 which communicates with the wellbore 4 by a way of a control conduit 26, which extends below blowout preventer 18.

A testing string 30 is shown disposed in wellbore 4, with blowout preventer 18 closed thereabout. Testing string 30 includes upper drill pipe string 32 which extends downward from platform 2 to wellhead 16, whereat is located hydraulically operated "test tree" 34, below which extends intermediate pipe string 36. A slip joint 38 may be included in string 36 to compensate for vertical motion imparted to platform 2 by wave action. This slip joint 38 may be similar to that disclosed in U.S. Pat. No. 3,354,950 to Hyde, or of any other appropriate type as well known to the art. Below slip joint 38, intermediate string 36 extends downwardly to the exemplary multi-mode testing tool 100 in accordance with the present invention.

Multi-mode testing tool 100 is a combination circulating and well closure valve. The structure and operation of the valve opening and closing assemblies of well tool 100 are of the type utilized in the valve known by the trade name "Omni ®" valve manufactured and used by Halliburton Services. The structure and operation of the valve opening and closing assemblies are similar to those described in U.S. Pat. No. 4,633,952, issued Jan. 6, 1987, to Paul Ringgenberg and U.S. Pat. No. 4,711,305, issued Dec. 8, 1987, to Paul Ringgenberg, both patents being assigned to the assignee of the present invention. The entire disclosures including the specifications of U.S. Pat. Nos. 4,711,305 and 4,633,952 are incorporated herein by reference for all purposes.

Below multi-mode testing tool 100 is an annulus pressure-operated tester valve 50 and a lower pipe string 40, extending to tubing seal assembly 42, which stabs into packer 44. When set, packer 44 isolates upper wellbore annulus 46 from lower wellbore annulus 48. Packer 44 may be any suitable packer well known to the art, such as, for example, a Baker Oil Tool Model D Packer, an Otis Engineering Corporation type W Packer, or an Easy Drill ® SV Packer. Tubing seal assembly 42 permits testing string 30 to communicate with lower wellbore 48 through perforated tailpipe 51. In this manner, formation fluids from potential producing formation 8 may enter lower wellbore 48 through perforations 54 in casing 10, and be routed into testing string 30.

After packer 44 is set in wellbore, a formation test controlling the flow of fluid from potential producing formation 8 through perforated casing 10 and through testing string 30 may be conducted using variations in pressure affected in upper annulus 46 by pump 24 and control conduit 26, with associated relief valves (not shown). Formation pressure, temperature, and recovery time may be measured during the flow test through the use of instruments incorporated in testing string 30 as known in the art, as tester valve 52 is opened and closed in a conventional manner. In this exemplary application, multi-mode testing tool 100 is capable of performing in different modes of operation as a drill string closure valve and a circulation valve, and provides the operator with the ability to displace fluids in the pipe string above the tool. Multi-mode testing tool 100 includes a ball and slot type ratchet mechanism which provides a specified sequence of opening and closing of the respective wellbore closure ball valve and circulating valve. Multi-mode testing tool also allows, in the circulation mode, the ability to circulate in either direction, so as to be able to spot chemicals or other fluids directly into the testing string bore from the surface, and to then open the well closure valve (and the well tester valve 52), to treat the formation therewith.

As will be apparent to those skilled in the art, during the conduct of the drill stem test achieved by opening and closing tester valve 52 for specified intervals for a predetermined number of cycles, it may be desirable that the multi-mode testing valve 100 not operate in any way in response to the pressure increases and decreases which serve to operate tester valve 52.

The prior art testing tool disclosed in U.S. Pat. Nos. 4,633,952 and 4,711,305 incorporated by reference earlier herein includes a series of "blind" ratchet positions whereby the tool will cycle through a predetermined number of pressure increases and decreases without initiating operation of either of the bore closure (ball) valve of the tool or the circulation valve. While this tool has performed admirably in most circumstances, such a system does present a limitation to the number of pressure cycles (and therefore valve openings and closings), which can be implemented during a drill stem test procedure. The present invention incorporates the same highly desirable feature of allowing a predetermined number of pressure increases and decreases to be cycled through before effecting a change in the opened or closed status of either the circulating valve or bore closure valve, but further facilitates preventing the operation or responsiveness of multi-mode testing tool to any such cycling pressure increases and decreases until a desired point in time when a activating pressure increase will be applied to multi-mode testing tool 100.

Referring now also to FIGS. 2A–G, therein is depicted an exemplary embodiment of a multi-mode testing tool 100 in accordance with the present invention. Tool 100 is shown primarily in half vertical section, commencing at the top of the tool with upper adaptor 101 having threads 102 secured at its upper end, whereby tool 100 is secured to drill pipe in the testing string. Upper adaptor 101 is secured to nitrogen valve housing 104 at a threaded connection 106. Nitrogen valve housing 104 includes a conventional valve assembly (not shown), such as is well known in the art for facilitating the introduction of nitrogen gas into tool 100 through a lateral bore 108 in nitrogen valve housing 104. Lateral bore 108 communicates with a downwardly extending longitudinal nitrogen charging channel 110.

Nitrogen valve housing 104 is secured by a threaded connection 112 at its lower end to tubular pressure case 114, and by threaded connection 116 at its inner lower end to gas chamber mandrel 118. Tubular pressure case 114 and gas chamber mandrel 118 define a pressurized gas chamber 120, and an upper oil chamber 122. These two chambers 120, 122 are separated by a floating annular piston 124. Tubular pressure case 114 is coupled at a lower end by thread connections 128 to hydraulic lockout housing 126. Hydraulic lockout housing 126 extends between tubular pressure case 114 and gas chamber mandrel 118. Hydraulic lockout housing 126 houses a portion of the hydraulic lockout assembly, indicated generally at 130, in accordance with the present invention. Although some components of hydraulic lockout assembly 130 are depicted in FIG. 2, these elements will be discussed in reference to FIG. 3, wherein they are depicted completely and in greater detail. Hydraulic lockout assembly 130 includes passages, as will be described in relation to FIG. 3, which selectively allow fluid communication of oil, through hydraulic lockout housing 126, between upper oil chamber 122 and an annular ratchet chamber 158.

Figure 5:
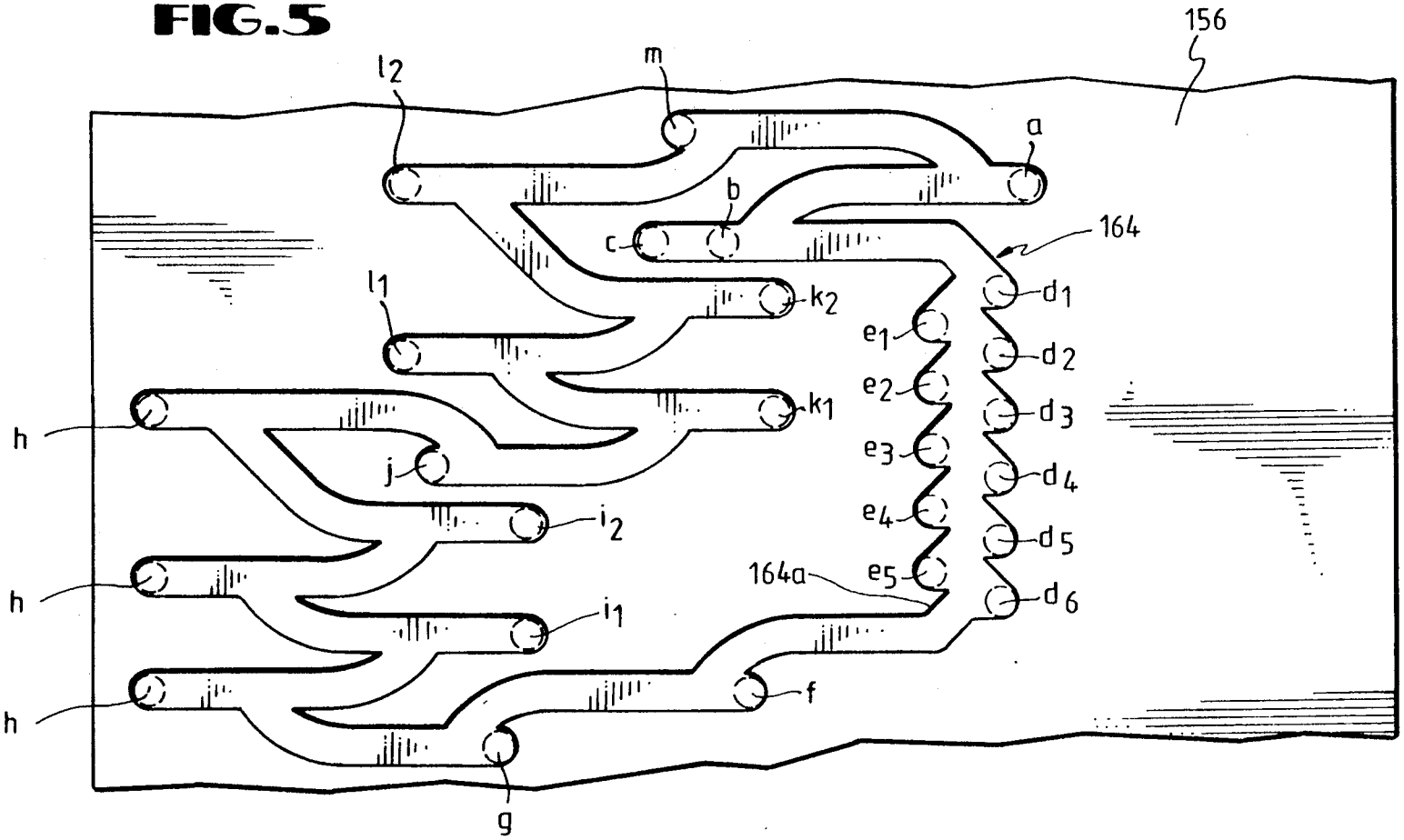
FIG. 5 schematically depicts one exemplary embodiment of a ratchet slot arranged suitable for use with the well tool of FIG. 2.

Hydraulic lockout housing 126 is coupled by way of a threaded connection 140 to the upper end of ratchet case 142. A ratchet slot mandrel 156 sealingly engages the lower end of hydraulic lockout housing 126 to cooperatively, (along with hydraulic lockout housing 126 and ratchet case 142) define annular ratchet chamber 158. Ratchet slot mandrel 156 extends upwardly within the lower end of hydraulic lockout housing 126. The upper exterior 160 of mandrel 156 is of substantially uniform diameter, while the lower exterior 162 is of greater diameter so as to provide sufficient wall thickness for ratchet slots 164. Ratchet slots 164 may be of the configuration shown in FIG. 5. FIG. 5 depicts one preferred embodiment of ratchet slot design 164 utilized in one preferred embodiment of the invention. There are preferably two such ratchet slots 164 extending around the exterior of ratchet slot mandrel 156.

Figure 2A:
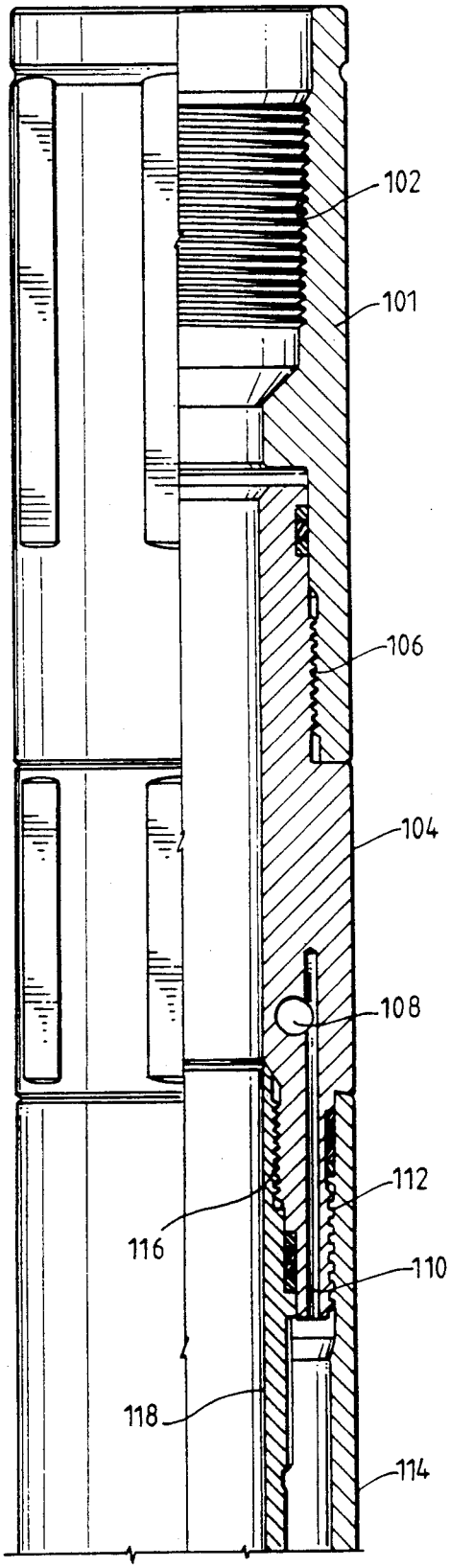
Figure 2B:
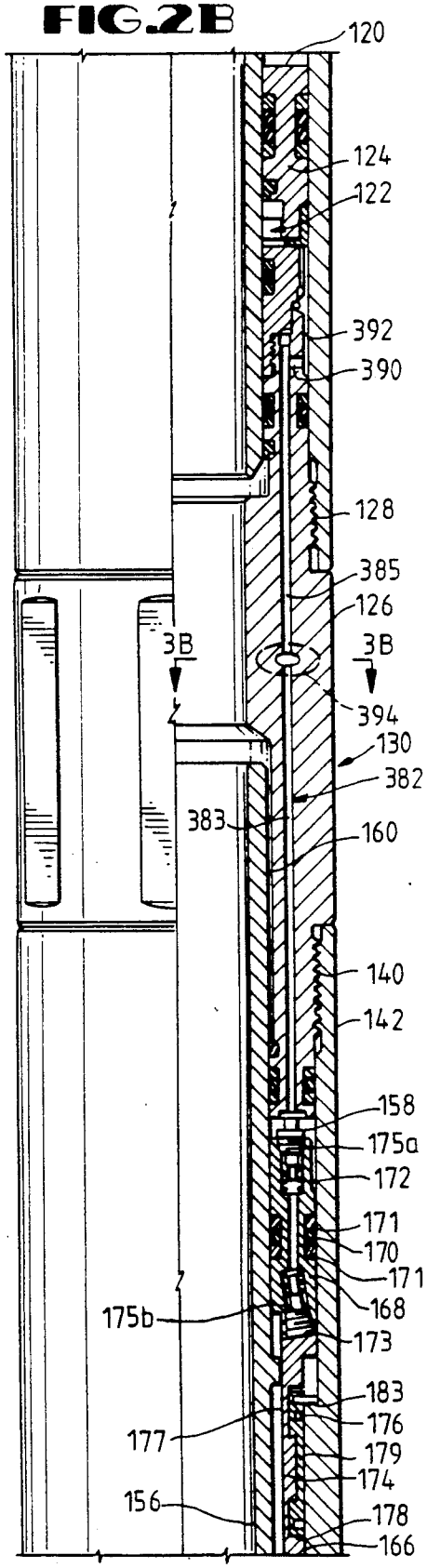
Figure 2C:
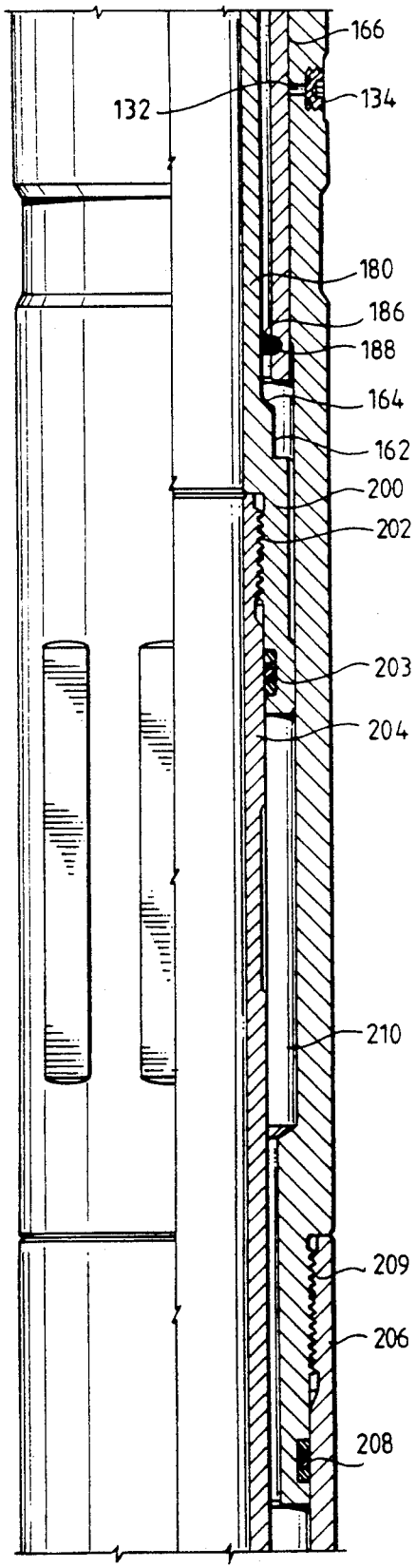
Figure 2D:
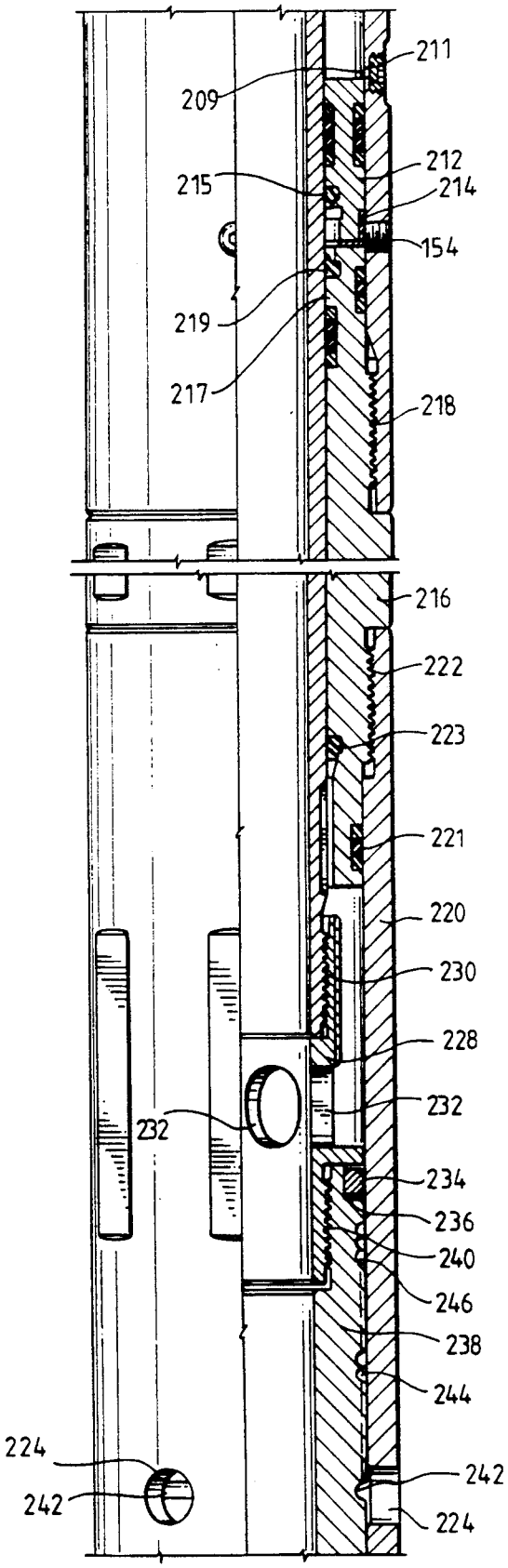
Figure 2G:
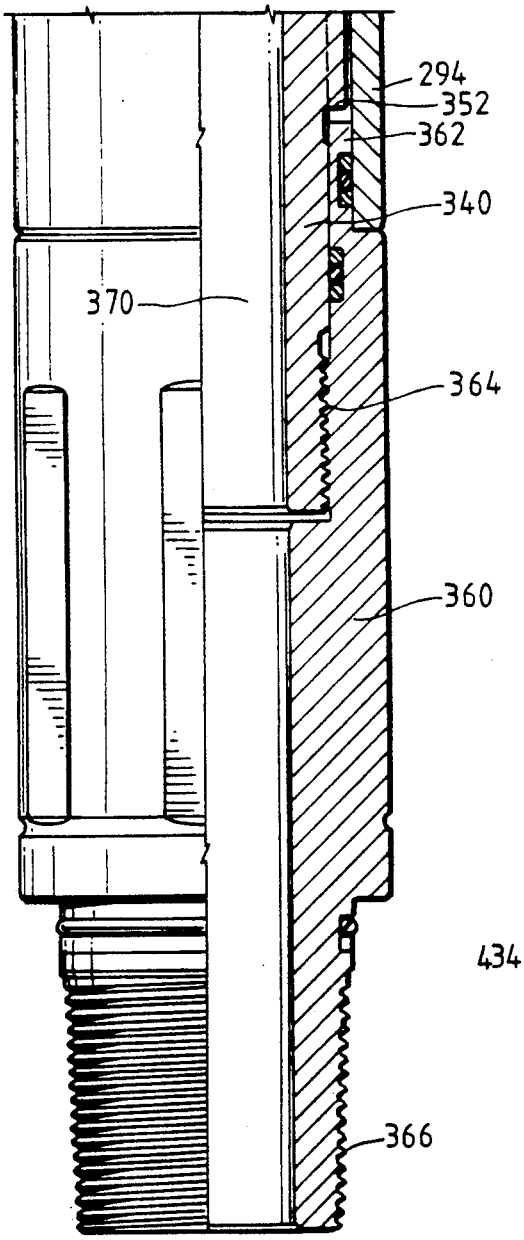

Ball sleeve assembly 166 surrounds ratchet slot mandrel 156 and comprises an upper sleeve/check valve housing 168 and a lower sleeve 174. Upper sleeve/check valve housing 168 includes seals 170 and 171 which sealingly engage the adjacent surfaces of ratchet case 142 and ratchet slot mandrel 156, respectively. Upper sleeve/check valve housing 168 also includes a plurality of check valve bores 172 opening upwardly, and a plurality of check valve bores 173 opening downwardly. One each of check valve bores 172 and 173 are are depicted in FIG. 2B; however, in one preferred embodiment, two check valves extending in each direction, generally diametrically opposite one another will be utilized. Each check valve bore 172, 173 will include a check valve 175*a*, 175*b*. Exemplary check valves for use as Check valves 175*a*, 175*b* are depicted in greater detail in FIG. 4. Upper sleeve/check valve housing 168 and lower sleeve 174 are preferably coupled together by a split ring 179 secured in place with appropriately sized C rings 176; which split ring 179 engages recesses 177 and 178 on upper sleeve/check valve housing 168 and lower sleeve 174, respectively. Coupling split ring 179 is preferably an annular member having the appropriate configuration to engage annular slots 177 and 178 which has then been cut along a diameter to yield essentially symmetrical halves. Ratchet case 142 includes an inwardly extending shoulder 183, which will serve as an actuating surface for check valve 175*b*. Ratchet case 142 includes an oil fill port 132 which extends from the exterior surface to the interior of ratchet case 142 and allows the introduction of oil into annular ratchet chamber 158 and connected areas. Oil fill ports 132 are closed with conventional plugs 134 which threadably engage ratchet case 142 and seal ratchet chamber 158 from the exterior of tool 100.

The lower end of lower sleeve 174 of ball sleeve assembly 166 is able to rotate relative to upper sleeve/check valve housing 168 by virtue of the connection obtained by split ring 179. Lower sleeve 174 includes at least one, and preferably two, ball seats 188, which each contain a ratchet ball 186. Ball seats 188 are preferably located on diametrically opposite sides of lower sleeve 174. Due to this structure, when ratchet balls 186 follow the path of ratchet slots 164, lower sleeve 174 rotates with respect to upper sleeve/check valve housing 168. Upper sleeve/check valve housing 168 of ball sleeve assembly 166 does not rotate, and only longitudinal movement is transmitted to ratchet mandrel 156 through ratchet balls 186. Lower extreme 180 of ratchet slot mandrel 156 includes an outwardly extending lower end 200 which is secured at a threaded connection 202 to an extension mandrel 204. Ratchet case 142 and attached piston case 206, and extension mandrel 204, cooperatively define annular lower oil chamber 210. A seal assembly 208 forms a fluid tight seal between ratchet case 142 and piston case 206. A seal 203 provides a sealing engagement between extension mandrel 204 and lower end 200 of ratchet slot mandrel 156.

An annular floating piston 212 slidingly seals the bottom of lower oil chamber 210 and divides it from well fluid chamber 214 into which pressure ports 154 open. Annular piston 212 includes a conventional sealing arrangement and also preferably includes an elastomeric wiper member 215 to help preserve the sealing engagement between annular piston 212 and extension mandrel 204. Piston case 206 includes another oil fill port 209 sealed by a plug 211. The lower end of piston case 206 is secured at threaded connection 218 to extension nipple 216. The uppermost inside end 217 again preferably includes an elastomeric wiper 219 to preserve the sealing engagement between extension nipple 216 and extension mandrel 204. Extension nipple 216 is also preferably coupled by threaded coupling 222 to circulation-displacement housing 220, and a seal 221 is established therebetween. Extension nipple 216 also preferably includes a lower wiper assembly 223 to help preserve the seal between extension nipple 216 and extension mandrel 204. Circulation/displacement housing 220 includes a plurality of circumferentially-spaced radially extending circulation ports 224, and also includes a plurality of pressure equalization ports 226. A circulation valve sleeve 228 is coupled by way of a threaded coupling 230 to the lower end of extension mandrel 204. Valve apertures 232 extend through the wall of sleeve 228 and are isolated from circulation ports 224 by an annular elastomeric seal 234 disposed in seal recess 236. Elastomeric seal 234 may have metal corners fitted therein for improved durability as it moves across circulation ports 224. Partially defined by the juncture of circulation valve sleeve 228 with displacement valve sleeve 238. Circulation valve sleeve 228 is coupled to displacement valve sleeve 238 by a threaded coupling 240.

Displacement valve sleeve 238 preferably includes a plurality of index groove sets 242, 244, and 246. Each of these index groove sets is visible through circulation ports 224 depending upon the position of displacement valve sleeve 238, and therefore of ratchet slot mandrel 156 relative to the exterior housing members, including circulation displacement housing 220. Accordingly, inspection grooves 242, 244, and 246 allow visual inspection and confirmation of the position of displacement sleeve 238 and therefore the orientation of tool 100 in its ratchet sequence. Displacement valve sleeve 238 includes a sealing arrangement 248 to provide a sealing engagement between displacement mandrel 238 and circulation-displacement housing 220. Beneath a radially outwardly extending shoulder 249 at the upper end of displacement mandrel 238 is a sleeve section 260. Sleeve section 260 extends downwardly and includes an exterior annular recess 266 which separates an elongated annular extension shoulder 268 from the remaining upper portion of displacement mandrel 238.

A collet sleeve 270, having collet fingers 272 extending upper therefrom engages extension sleeve 260 of displacement mandrel 238 through radially inwardly extending protrusions 274 which engage annular recess 266. As can be seen in FIG. 2E, protrusions 274 and the upper portions of fingers 272 are confined between the exterior of lower mandrel section 260 and the interior of circulation-displacement housing 220.

As can also be seen in FIG. 2E, lower mandrel section 260 also includes a seal 265 which seals against collet sleeve 270 at a point below the lowermost extent 267 of collet fingers 272. This assures a secure seal between lower section 260 and collet sleeve 270. Collet sleeve 270 has a lower end which includes flanged coupling, indicated generally at 276, and including flanges 278 and 280, which flanges define an exterior annular recess 282 therebetween. Flange coupling 276 receives and engages a flange coupling, indicated generally at 284, on each of two ball operating arms 292. Flange coupling 284 includes inwardly extending flanges 286 and 288, which define an interior recess 290 therebetween. Flange couplings 276 and 284 are maintained in their intermeshed engagement by their location in annular recess 296 between ball case 294 and ball housing 298. Ball case 294 is threadably coupled at 295 to circulation-displacement housing 220.

Ball housing 298 is of a substantially tubular configuration having an upper, smaller diameter portion 300 and a lower, larger diameter portion 302, which has two windows 304 cut through the wall thereof to accommodate the inward protrusion of lugs 306 from each of the two ball operating arms 292. Ball housing 298 also includes an aperture 301 extending between the interior bore and annular recess 296. This bore prevents a fluid lock from restricting movement of displacement valve sleeve 238.

On the exterior of ball housing 298, two longitudinal channels, indicated generally by arrow 308, of arcuate cross-section, and circumferentially aligned with windows 304, extend from shoulder 310 downward to shoulder 311. Ball operating arms 292 which have substantially complementary arcuate cross-sections as channels 308 and lower portion 302 of ball housing 298, lie in channels 308 and across windows 304, and are maintained in place by the interior wall 318 of ball case 294 and the exterior of ball support 340.

The interior of ball housing 298 includes an upper annular seat recess 320 within which annular seat 322 is disposed. Ball housing 298 is biased downwardly against ball 330 by ring spring 324. Surface 326 of upper seat 322 includes a metal sealing surface which provides a sliding seal with exterior 332 of ball valve 330. Valve ball 330 includes a diametrical bore 334 therethrough, which bore 334 is of substantially the same diameter as bore 328 of ball housing 298. Two lug recesses 336 extend from the exterior 332 of valve ball 330 to bore 334. The upper end 342 of ball support 340 extends into ball housing 298 and preferably carriers lower ball seat recess 344 in which a lower annular ball seat 346 is disposed. Lower annular ball seat 346 includes an arcuate metal sealing surface 348 which slidingly seals against the exterior 332 of valve ball 330. When ball housing 298 is assembled with ball support 340, upper and lower ball seats 322 and 346 are biased into sealing engagement with valve ball 330 by spring 324. Exterior annular shoulder 350 on ball support 340 is preferably contacted by the upper ends 352 of splines 354 on the exterior of ball case 294, whereby the assembly of ball housing 294, ball operating arms 292, valve ball 330, ball seats 322 and 346 and spring 324 are maintained in position inside of ball case 294. Splines 354 engage splines 356 on the exterior of ball support 340, and thus rotation of the ball support 340 and ball housing 298 within ball case 298 is prevented.

Lower adaptor 360 protrudes that its upper end 362 between ball case 298 and ball support 340, sealing therebetween, when made up of ball support 340 at threaded connection 364. The lower end of lower adaptor 360 includes exterior threads 366 for making up with portions of a test string below multi-mode testing tool 100.

As will be readily appreciated, when valve ball 330 is in its opened position, as depicted in FIG. 2F, a "full open" bore 370 extends throughout multi-mode testing tool 100, providing a path for formation fluids and/or for perforating guns, wireline instrumentation, etc.

Figure 3B:
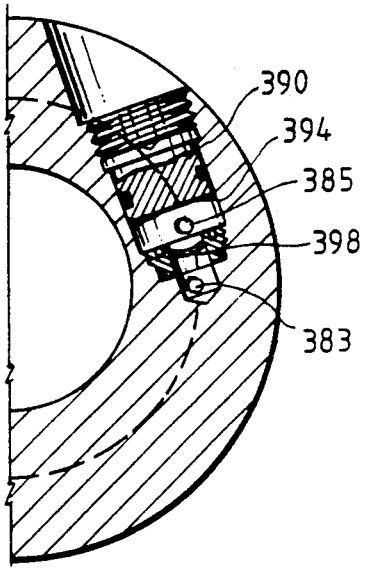
FIGS. 3A-B depicts the selective pressure lockout sub of the apparatus of FIG. 2, in greater detail, illustrated in vertically section.
Figure 3A:
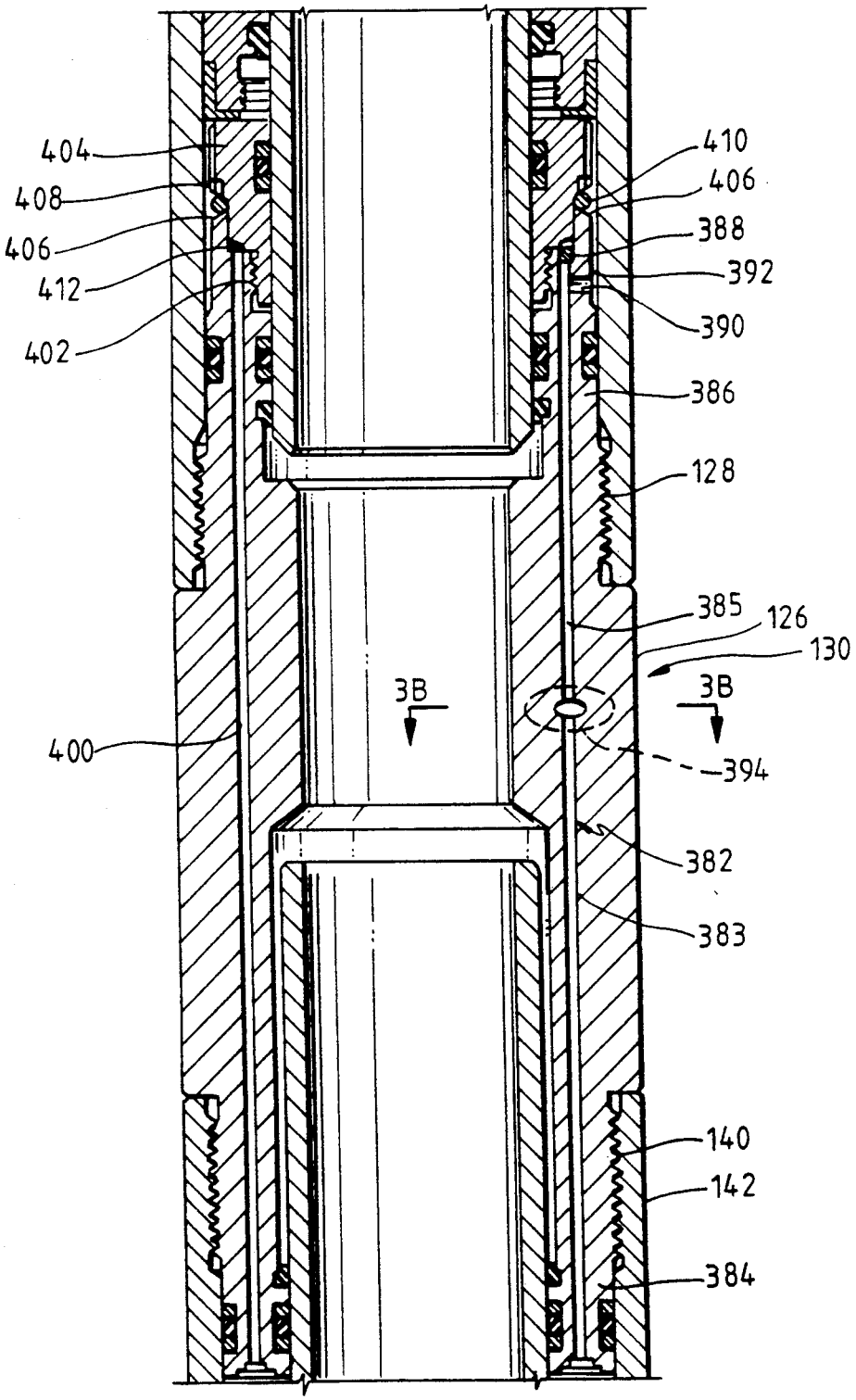

Referring now to FIG. 3, therein is depicted hydraulic lockout assembly 130 in greater detail. As previously stated, hydraulic lockout assembly 130 includes hydraulic lockout sub 126. Hydraulic lockout sub 126 includes a first generally longitudinal passageway 382 which extends from the lower end 384 of housing 126 to proximate upper end 386. As can be seen from a comparison of FIGS. 3A and 3B, longitudinal passageway 382 will preferably be formed of two offset bores 383, 385. The upper extent of passageway 382 (i.e., bore 385), is plugged such as by a suitable metal plug 388, using any conventional technique as is well known to the art. Bore 385 intersects a lateral bore 390 which communicates passageway 382 with an annular recessed area 392 formed between the exterior of hydraulic lockout sub 126 and tubular pressure case 114. On the opposing side of radial aperture 390 from plug 388, is another lateral aperture 394 which communicates bores 383 and 385. Lateral aperture 394 contains a rupture disk plug 396 which defines a flow path which is, at an initial stage, occluded by a rupture disk 398. As will be appreciated from FIGS. 3A–B, plug 396 secures rupture disk 398 in position such that any flow through passageway 382 is prevented by rupture disk 398, until such time as a pressure differential will cause rupture disk to yield, thereby opening passageway 382. Hydraulic lockout sub 126 also includes a passageway 400 which extends from lower end 384 of sub 126 to upper end 386 of sub 126. Bore passageway 400 is preferably diametrically opposed to bore 382 in sub 126. Proximate the upper end of hydraulic lockout sub 126, the sub is secured such as by a threaded coupling 402 to an end cap 404. Hydraulic lockout sub 126 and end cap 404 include generally adjacent complementary surfaces which are each angularly disposed so as to form a generally V-shaped recess 406 therebetween. A portion of this recess is relieved in end cap 404 by an annular groove 408. Disposed in annular recess 406 is a conventional O-ring 410 which, as will be described in more detail later herein, serves as a check valve for flow between passage 400 in hydraulic lockout sub 126 and upper oil chamber 122, beneath floating annular piston 124. A small recess 412 is provided between end cap 404 and hydraulic lockout sub 126 adjacent bore 400 to assure fluid communication between bore 400 and V-shaped groove 406 beneath O-ring 410.

Figure 4:
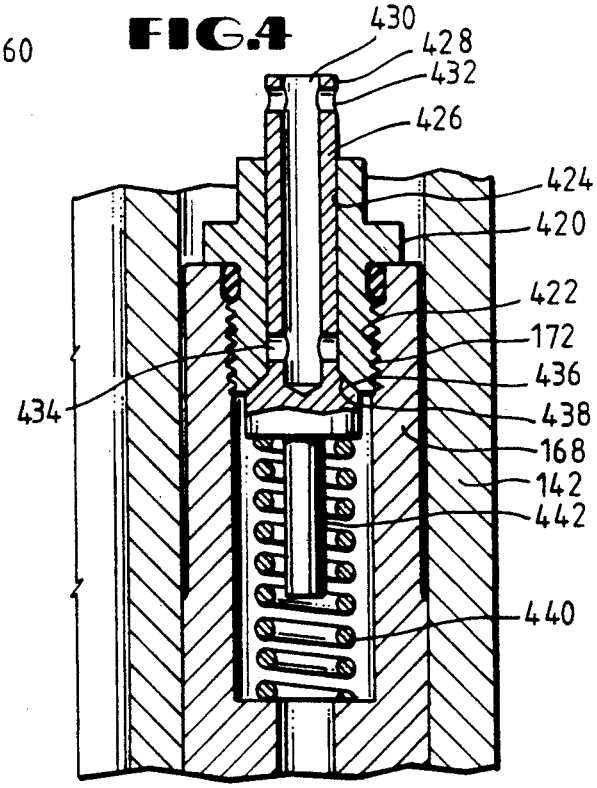
FIG. 4 depicts the check valve assembly of the apparatus of FIG. 2 in greater detail, illustrated in vertical section.

Referring now to FIG. 4, therein is depicted an exemplary check valve 175 as is useful for each check valve in upper sleeve/check valve housing 168 of multipurpose testing tool 100. Check valve 175 includes a body member 420 having an external threaded section 422 adapted to threadably engage the bores 172, 173 in upper sleeve/check valve housing 168. Body 420 defines a central bore 424 in which is located check valve stem 426. Stem 426 includes a central bore extending from the outermost end 428 to a position inside stem 426. First and second lateral bores 432, 434 intersect central bore 430. First and second lateral bores 432, 434 are spaced sufficiently far apart that when stem 426 is moved in its only direction of movement away from body member 420 (i.e., down as depicted in FIG. 4), lateral bores 432 and 434 will be on opposed sides of body member 420. These bores assure appropriate fluid flow through check valve 175. Stem 426 and body member 420 also include complementary sealing surfaces 436 and 438, respectively, which occlude flow when the surfaces are in engagement with one another. Check valve 175 further includes a spring member 440 which urges stem and body member seating surfaces 436 and 438 toward one another to assure a sealing relationship therebetween. Stem 426 preferably includes an elongated extension member 442 which extends through spring 440 and serves to keep spring 440 properly aligned in an operating configuration therewith.

Referring now to all of FIGS. 1–4, operation of multi-mode testing tool 100 is as follows. As tool 100 is run into the well in testing string 30, it will typically be run with the circulating valve closed and with the ball valve in its open position, as depicted in FIGS. 2A–G. As tool 100 moves downwardly within the wellbore, annulus pressure will enter through annulus pressure port 154 and urge annular floating piston 212 upwardly in annular lower oil chamber 210. The pressure will be communicated through the oil tool 100, and through passageway 400 in hydraulic lockout sub 126. As the pressure passes through passageway 100, and becomes greater than the pressure in pressurized gas chamber 120 acting on check valve O-ring 410, the pressure will urge check valve O-ring 410 outwardly, and will act upon the lower surface of floating annular piston 124. Floating annular piston 124 then will move upwardly, pressurizing the nitrogen in pressurized gas chamber 120 to be essentially equal to the annular hydrostatic pressure (discounting, for example, frictional losses within tool 100).

As is apparent from the figures, rupture disk 398 will be exposed on one side, in bore 383, to the pressure of fluid in the wellbore, and will be exposed on the other side, in bore 385, to the pressure trapped in pressurized gas chamber 120. The valve of rupture disk 398 will be set at some safety margin over the maximum pressure which is expected to be applied to operate other tools in the tool string. For example, if a pressure of 500 psi. above hydrostatic is expected to be applied to tester valve 52 in tool string 30, then the value of rupture disk 398 would preferably be set at 750 to 1,500 pounds above, and most preferably would be set at approximately 1,000 pounds. Accordingly, rupture disk 398 will not rupture until a pressure of 1,000 pounds is applied thereacross.

As will therefore be appreciated, pressure in the annulus may be raised and lowered any number of times to operate tester valve 52 as desired. The maximum pressure applied in the annulus adjacent multi-mode testing tool 100 will be applied, as described earlier herein, through hydraulic lockout assembly 380 to pressurize gas chamber 120. Thus, the pressure within pressurized gas chamber 130 will remain at the highest pressure applied to the annulus.

When it is desired to actuate multi-mode testing tool 100, the pressure will be elevated a single time to the differential above hydrostatic at which rupture disk 398 is set, preferably with an extra margin to assure reliable operation. For example, with a 1,000 pound burst disk, a pressure of at least 1,000 pounds would be applied to the annulus. When this pressure is applied adjacent multi-mode testing tool 100, it will be trapped by hydraulic lockout assembly 130. As the pressure is reduced to hydrostatic, the differential of 1,000 pounds will be applied across the rupture disk 398, and it will rupture, thereby facilitating normal operation of the tool 100, as described in U.S. Pat. No. 4,711,305, incorporated by reference earlier herein. Force from the pressure in the fluid spring established by pressurized gas chamber 120 and piston 124 will then be applied to the piston area of upper sleeve/check valve housing 168, which serves as a movable operating mandrel, through balls 186.

A subsequent increase in pressure through annulus pressure ports 154 acts against upper sleeve/check valve housing 168. The oil is prevented from bypassing housing 168 by seals 170, 171. Upper sleeve/check valve housing 168 is therefore pushed against lower end 384 of hydraulic lockout sub 126. This movement pulls lower sleeve 174, ball sleeve 180, and balls 186 upward in slots 164. In this manner, balls 186 begin to cycle through ratchet slots 164.

When upper sleeve/check valve housing 168 reaches lower end 384 of hydraulic lockout sub 126, it is restrained from additional upward movement, but check valve 175 will open, (and, in turn, due to the recruiting pressure differential a check valve 175*b*, it too will open), allowing fluid to pass through passages 400 and 382 into upper oil chamber 122, which equalizes the pressures on both sides upper sleeve/check valve housing 168 and stops the movement of ball sleeve assembly 156 and of balls 186 in slots 164. As annulus pressure is bled off, the pressurized nitrogen in chamber 120, now that rupture disk 398 is broken, pushes against floating piston 124, which pressure is then transmitted through upper oil chamber 122 and passageway 382 against upper sleeve/check valve housing 168, biasing it and lower sleeve 174 downwardly, causing ratchet balls 186 to further follow the paths of slots 164. After a selected number of such cycles as determined by the ratchet, the ratchet will cause balls 186 to move ratchet mandrel, 156 extension mandrel 204 and sleeve attached thereto, opening either the circulating valve or ball valve.

Figure 6:
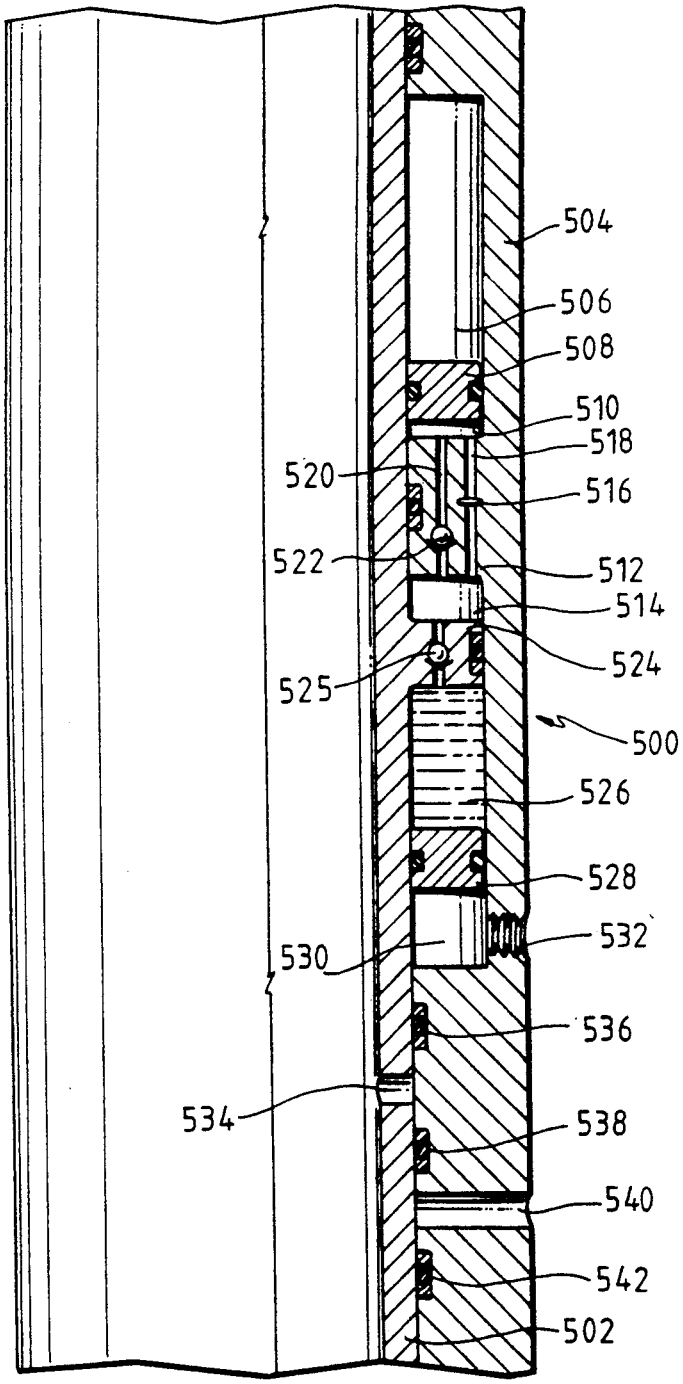
FIG. 6 schematically depicts an exemplary construction of an operating section of a well tool designed to facilitate operation of the tool at a predetermined pressure differential.

Referring now to FIG. 6, therein is schematically disclosed an exemplary embodiment of an operating system for a well tool 500 incorporating a hydraulic lockout method and apparatus in accordance with the present invention. Well tool 500 includes a movable mandrel 502 which represents the key operating mechanism which is being restrained from movement until after a specified pressure differential has occurred, enabling operability of tool 500.

For purposes of clarity of illustration, well tool 500 will be described in terms of an automatic drain valve for allowing fluid to drain from a drill stem testing string as it is pulled from the well. The description of tool 500 relative to such a tool is purely illustrative, however, as those skilled in the art will readily recognize that the principles of the schematically illustrated embodiment could be applied to a circulating/safety valve, or numerous other types of well tools. Well tool 500 includes, in addition to movable mandrel 502, a housing assembly 504. Housing assembly 504 and movable mandrel 502 cooperatively serve to define an upper gas chamber 506. Upper gas chamber 506 will be filled through an appropriate mechanism (not shown) with a volume of gas, preferably nitrogen, suitable to provide a desired resistance in tool 500. At the lower end of upper gas chamber 506 is a movable piston 508. Beneath movable piston 508 is an upper oil chamber 510. The opposing end of upper oil chamber 510 is defined by a delay assembly which may be either formed into an extension of housing assembly 504 or may be sealingly secured thereto. Hydraulic lockout assembly 512 sealingly engages movable mandrel 502 so as to define both an upper oil chamber 510 and intermediate oil chamber 514. Hydraulic lockout block assembly 512 includes a rupture disk assembly 516 which may be of the type previously disclosed herein which, at least initially, occludes a passageway 518 between upper and intermediate oil chambers 510 and 514, respectively. Hydraulic lockout assembly 512 also includes a second passageway 520 extending between upper and intermediate oil chambers 510 and 514, and which includes a check valve assembly 522 therein. Check valve assembly 522 serves to allow fluid flow from intermediate oil chamber 514 through passage 520 and into upper oil chamber 510 and against the lower side of piston 508, but to preclude flow in the opposing direction. The lowermost end of intermediate oil chamber 514 is defined by an annularly outwardly extending flange 524 on movable mandrel 502 which sealing engages housing assembly 504. Flange 524 also serves to define the upper extent of lower oil chamber 526. A check valve 525 in flange 524 allows the flow of oil from lower oil chamber 526 into intermediate oil chamber 514, and again, precludes flow in the opposing direction. A movable piston 528 separates lower oil chamber 526 from an annular pressure chamber 30 which communicates through a passage 532 with the well annulus exterior to tool 500. Movable mandrel 502 includes an inner drain port 534 which, in a first position as depicted in FIG. 6, is isolated on upper and lower sides by sealing assemblies 536 and 538. Well tool 500 also includes an annular drain port 540 which, when inner drain port 544 is aligned therewith, will allow the passage of fluid from the interior of tool 500 to the exterior. Pressure in annular drain port 540 is further isolated from additional extensions of movable mandrel 502 by an additional sealing assembly 542.

The operation of well tool 500 is similar to that described above with respect to the multi-mode testing tool 100 of FIGS. 1–5. As pressure is applied in the well annulus, that pressure will be applied through annulus pressure port 532 to piston 528 which will move and transmit the applied pressure through the oil and lower oil chamber 526. This pressure will then move movable mandrel 502 upwardly, and through the action of check valve 525, the applied annulus pressure will be transmitted through hydraulic lockout unit 512 to upper oil chamber 510, and thereby to the fluid spring formed by upper gas chamber 506. As previously described, due to construction of hydraulic lockout assembly 512, upon reduction of this pressure, the pressure will be trapped in upper gas chamber 506 through operation of rupture disk 516 and check valve 522.

As tool 500 is withdrawn from the well, or as the hydrostatic head of fluid proximate annulus pressure part 532 is otherwise reduced, the differential across rupture disk 516 will increase. When the differential reaches the predetermined differential at which the rupture disk will rupture, the disk will rupture, and the pressure in nitrogen chamber 506 will be applied through passage 518 to intermediate oil chamber 514 and to radial flange 524. Because the fluid and pressure may not bypass flange 524, movable mandrel 502 will be driven downwardly. In this illustrated example, such a downward movement will cause intermediate drain port 534 to align with annular drain port 540, allowing fluid in the bore of tool 500 to drain to the annulus.

Figure 7:
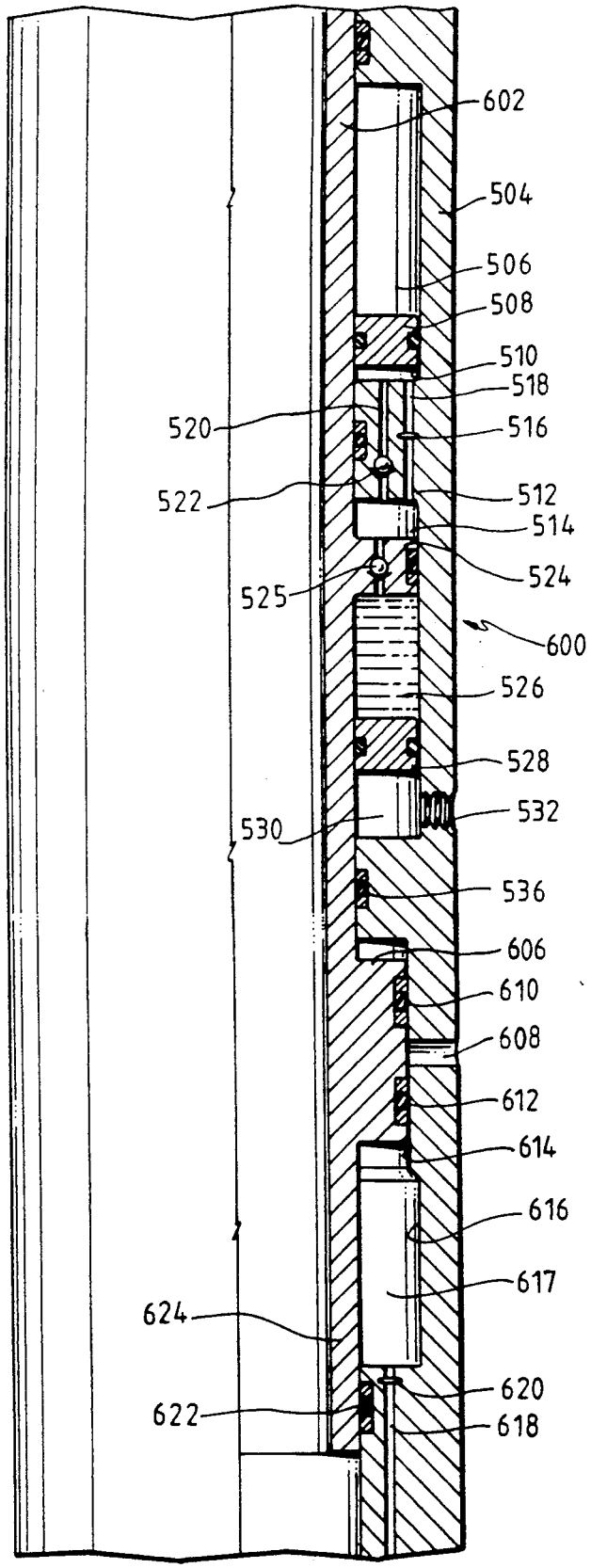
FIG. 7 schematically depicts another exemplary construction of an operating section of a well tool designed to facilitate operation of a conventional pressure operated well tool after a predetermined pressure differential has been achieved.

Referring now to FIG. 7, therein is depicted an alternative embodiment of a well tool 600 in accordance with the present invention. Well tool 600 provides a lockout mechanism which may be coupled to any appropriate type of pressure operated well tool to prevent operation of the tool until after a predetermined pressure differential has been achieved. For example, the hydraulic lockout operating section of tool 600 could be adapted to a circulating valve, safety valve, etc. One particular use would be for use with a tool in a drill stem testing operation where hydrostatic conditions in the borehole have changed since the time the tool was placed into the borehole. For example, if heavy fluid in the tubing had been replaced with a lighter fluid, or if the fluid level in the annulus had been reduced for some reason, thereby reducing the hydrostatic head adjacent well tool 600. Well tool 600 includes components and assemblies which correspond to those described and depicted relative to well tool 500. Accordingly, such elements are numbered similarly, and the same description is applicable here.

As will be apparent from FIG. 7, housing assembly 604, proximate the lower end, includes an annulus pressure aperture 608. Moveable mandrel 602 includes a radially outwardly extending section 606 including seal assemblies 610 and 612. Assemblies 610 and 612 are initially on opposing sides of annulus pressure port 608 so as to isolate port 608. Mandrel 602 and housing 604 cooperatively define a lower pressure chamber 617 which includes a radial recess 616. The walls defining recess 616 are radially outwardly placed relative to sealing surface 614 which engages sealing assembly 610 and 612. Accordingly, if movable mandrel 602 is moved downwardly to a position where sealing assemblies 610 and 612 are adjacent recess 616, then fluid from annulus pressure port 608 may be in fluid communication with chamber 617 through recess 616. A lower sealing assembly 622 engages a lower skirt portion 624 movable mandrel 602 to isolate pressure chamber 617. Chamber 617 is coupled through a passage 618 to the annulus pressure inlet port of the specific conventional well tool to be operated.

In operation, well tool 600 will function similarly to well tool 500 described above. Once the prescribed pressure differential has been achieved across rupture disk 516, the disk will rupture and pressure will be allowed to act upon outwardly extending flange 524 to move movable mandrel 602 downwardly. In the operating situation where well tool 600 has been placed into the well with a heavy fluid in the well, tool 600 will serve to preclude the heavy hydrostatic head from operably affecting the attached well tool. It will be apparent to those skilled in the art, when such heavy fluid is then replaced in the well by a lighter fluid, the rupture disk will be exposed on one side to pressure in gas chamber 606 equal to the hydrostatic head of the heavier fluid plus any additional pressure which was applied thereto. Meanwhile, the pressure on the opposing side of rupture disk 516 will be the hydrostatic head presented as the heavier fluid is replaced with the lighter fluid. Once this pressure differential exceeds the rupture value of rupture disk 516, the disk will then rupture enabling further operation of well tool 600.

As movable mandrel 602 moves downwardly, annular pressure port 608 will be uncovered, and will communicate thorough recess 616 in chamber 617 with passageway 618. Rupture disk 620, occluding passageway 618 will be established as whatever value is deemed appropriate to provide the initial operating pressure for the attached valve or other well tool. Thus, rupture disk 620 may be established at any desired value in the well, such as for example 1,000 psi. relative to only the lesser hydrostatic head presented by the lighter fluid in the well, and without regard for pressures which would have been previously present in the well as a result of the original, heavier, fluid.

Many modifications and variations may be made in the techniques and structures described and illustrated herein without departing from the spirit and scope of the present invention. For example, hydraulic lockout systems may be applied to a variety of different types of tools. Additionally, many different structural options may be imagined for exploiting the advantages of the present invention. Accordingly, it should be readily understood that the embodiments and examples described herein are illustrative only and are not to be considered as limitations upon the scope of the present invention.

What is claimed is:

1. A well tool having a movable valve member responsive to a change in pressure from a pressure source for selectively moving said movable member, said well tool comprising:

a fluid spring, said movable member being selectively responsive to pressure from said fluid spring;

means for transferring pressure from said pressure source to said fluid spring upon an increase in pressure from said pressure source;

a releasable valve mechanism for substantially preventing communication of pressure from said fluid spring to said movable valve member in a first state, and for communicating pressure from said fluid spring to said movable valve member in a second state.

2. The well tool of claim 1, wherein said pressure source comprises the portion of the borehole surrounding said well tool when said tool is disposed in a borehole.

3. The well tool of claim 1, wherein said means for transferring pressure from said pressure source to said fluid spring comprises a fluid passage having a one way valve therein.

4. The well tool of claim 1, wherein said releasable valve mechanism comprises a passage in pressure communication with said fluid spring and with said movable member, said passage having a valve element operatively associated therewith, said valve element releasable in response to a pressure differential.

5. The well tool of claim 1, wherein said movable valve member is movable in response to a pressure differential between the pressure in said fluid spring and the pressure at said pressure source.

6. A well tool having a movable valve member responsive to a change in pressure from a pressure source, said well tool comprising:

a movable mandrel operably coupled to said movable valve member for moving said valve member, said mandrel comprising a piston surface;

a fluid spring operably coupled to said pressure source for receiving fluid pressure from said pressure source; and means for communicating said fluid pressure from said pressure source to said fluid spring, and for operably coupling pressure from said fluid spring to said movable mandrel after a predetermined change in pressure at said pressure source.

7. The well tool of claim 6, wherein said communicating means comprises a fluid passageway for communicating an increase in fluid pressure at said pressure source to said fluid spring, said passageway including a one way valve precluding release of said pressure from said fluid spring upon a decrease in pressure at said pressure source.

8. The well tool of claim 7, wherein said communicating means further comprises a passage for communicating pressure from said fluid spring to said movable mandrel, said passageway having a valve member therein precluding fluid flow through said passage until a predetermined pressure differential is achieved between said fluid spring and said pressure source.

9. The well tool of claim 6, wherein pressure from said pressure source is communicated through said communication means to said fluid spring through use of a generally noncompressible fluid.

10. A method for operating a pressure responsive well tool having a fluid spring and a movable mandrel selectively responsive to said fluid spring, comprising the steps of:

applying a pressure to a pressure source and communicating said pressure to said fluid spring;

maintaining said pressure in said fluid spring upon a reduction in pressure at said pressure source; and selectively communicating said pressure in said fluid spring to said movable mandrel.

11. The method of claim 10, wherein said step of selectively communicating said pressure in said fluid spring to said movable mandrel is accomplished by increasing said pressure at said pressure source to a predetermined level, and by subsequently decreasing said pressure at said pressure source from said predetermined level.

12. The method of claim 10, wherein said pressure responsive well tool comprises a valve which is moved between opened and closed positions in response to movement of said movable mandrel.

13. The method of claim 10, wherein said pressure at said pressure source is communicated to said fluid spring through use of a generally noncompressible fluid, and where said step of maintaining said pressure in said fluid spring is performed by passing said generally noncompressible fluid through a one way check valve which allows the flow of fluid to compress said fluid spring, but which precludes the flow of fluid to release pressure in said fluid spring.

14. A method for operating a well tool having a valve therein, said valve responsive to movement of a movable mandrel, said movable mandrel being movable in response to a fluid spring, said method comprising the steps:

applying a relatively increased pressure to a pressure source and communicating said pressure through use of a fluid medium to said fluid spring;

decreasing said pressure at said pressure source while maintaining a relatively increased pressure in said fluid spring; and communicating said pressure in said fluid spring to said movable mandrel in response to an increase in pressure at said pressure source in excess of said previously applied pressure level at said pressure source.

15. The method of claim 14, wherein said fluid is maintained in said fluid spring at a relatively increased pressure at least partially through use of a pressure-releasable valve, which pressure-releasable valve is released in response to a pressure differential between said fluid spring and fluid at set pressure source.

16. The method of claim 14, wherein said pressure source comprises the borehole annulus surrounding said tool when said well tool is utilized within a borehole.

17. The method of claim 15, wherein said fluid pressure is maintained in said fluid spring at least partially through use of a one way check valve precluding movement of said fluid medium in one direction.

18. A pressure responsive well tool for use in a borehole, said well tool having a valve therein, said valve member movable in response to a pressure in said borehole annulus surrounding said tool, said well tool comprising:

a housing assembly;

a mandrel assembly inside said housing assembly, said housing assembly and said mandrel assembly at least partially defining a fluid chamber;

a piston for communicating pressure in said annulus fluid chamber to a body of fluid in said tool;

a chamber at least partially defined by said housing assembly and said mandrel assembly, said chamber also partially defined by a movable piston, said chamber containing a gas adapted to be compressed in response to movement of said movable piston, said piston movable in response to an increase of pressure in said body of fluid to compress said gas;

a passage having a check valve therein for communicating pressure in said body of fluid to said movable piston, but not allowing said pressure to subsequently decrease in response to a decrease in pressure in said annulus fluid chamber; and a pressure-releasable valve responsive to a predetermined pressure differential to selectively communicate said pressure of said gas in said chamber to said movable mandrel to move said valve member between opened and closed positions.

* * * * *

UNITED STATES PATENT AND TRADEMARK OFFICE

CERTIFICATE OF CORRECTION

PATENT NO. : 5,180,015

DATED : January 19, 1993

INVENTOR(S) : Ringgenberg et al.

It is certified that error appears in the above-indentified patent and that said Letters Patent is hereby corrected as shown below:

On the title page, in the Abstract:

Line 13, after "and", insert --that at--.

In the Detailed Description of the Embodiments:

Column 4, line 43, after "testing", insert --valve 100 will be run into the well with its ball valve in the opened position. Multi-mode testing--.

Column 5, line 13, after "tool", insert --100--.

Signed and Sealed this

Fourteenth Day of December, 1993

Bruce Lehman

*Attest:*

BRUCE LEHMAN

*Attesting Officer*

*Commissioner of Patents and Trademarks*